US006458396B1

(12) United States Patent
Hirst

(10) Patent No.: US 6,458,396 B1
(45) Date of Patent: Oct. 1, 2002

(54) HARD TACO SHELL PROTECTIVE PACKAGING

(75) Inventor: Daniel J. Hirst, Austin, MN (US)

(73) Assignee: Hormel Foods, LLC, Austin, MN (US)

( * ) Notice: Subject to any disclaimer, the term of this patent is extended or adjusted under 35 U.S.C. 154(b) by 1 days.

(21) Appl. No.: 09/611,767

(22) Filed: Jul. 6, 2000

(51) Int. Cl.[7] ..... B65B 23/00

(52) U.S. Cl. ..... 426/124; 426/128; 426/106; 206/499; 206/521; 206/585; 206/586; 206/591; 206/593

(58) Field of Search ..... 426/106, 124, 426/128, 396; 206/497, 499, 521, 585, 586, 587, 591–594, 565, 461, 471; 229/87.02, 87.08

(56) References Cited

U.S. PATENT DOCUMENTS

| | | | | | |
|---|---|---|---|---|---|
| 2,197,506 | A | * | 4/1940 | Moss | 426/128 |
| 3,104,172 | A | * | 9/1963 | Wizelman | 426/119 |
| 3,708,946 | A | * | 1/1973 | Cahill | 53/37 |
| 3,896,928 | A | * | 7/1975 | Forte | 206/779 |
| 4,018,905 | A | | 4/1977 | Adamek et al. | 426/124 |
| 4,055,670 | A | | 10/1977 | Belmont | 426/119 |
| 4,158,408 | A | * | 6/1979 | Thiessen | 206/443 |
| 4,247,289 | A | * | 1/1981 | McCabe | 493/386 |
| 4,299,850 | A | | 11/1981 | Wallen et al. | 426/124 |
| 4,381,837 | A | | 5/1983 | Cortopassi | 206/485 |
| 4,579,276 | A | * | 4/1986 | Manizza | 229/15 |
| 4,653,645 | A | | 3/1987 | Thomas | 206/549 |
| 4,697,707 | A | | 10/1987 | Engdahl | 206/585 |
| 5,326,577 | A | | 7/1994 | Warnock | 426/124 |

OTHER PUBLICATIONS

Photo A of Taco Bell® Home Originals™ Taco Shells (1998).
Photo B of Old El Paso® Taco Shells (1997).
Photo C or Ortega® Taco Shells (1997).

* cited by examiner

*Primary Examiner*—Milton I. Cano
*Assistant Examiner*—Robert A. Madsen
(74) *Attorney, Agent, or Firm*—IPLM Group, P.A.

(57) ABSTRACT

The preferred embodiment protective packaging (10) is directed to a protective packaging for hard taco shells (27). It is understood, however, that the present invention may be modified to provide an improved packaging container for other brittle yet perishable food substances. The packaging (10) includes a pad (11) having legs (12, 13, 14, 15) that are compressed when a force is exerted upon them without breaking the taco shells (27). The pad (11) covers an area greater than the area covered by the taco shells (27). The taco shells (27) are packaged in a nested arrangement, and the packaging (10) also utilizes a paper board U-shaped insert (35) placed in the opening of the end taco shell, which protects the shells (27) from breaking in side to side impact. The shells (27) are shrink-wrapped onto the pad (11) and the pad (11) is then placed inside a protective carton.

13 Claims, 2 Drawing Sheets

FIG. 3
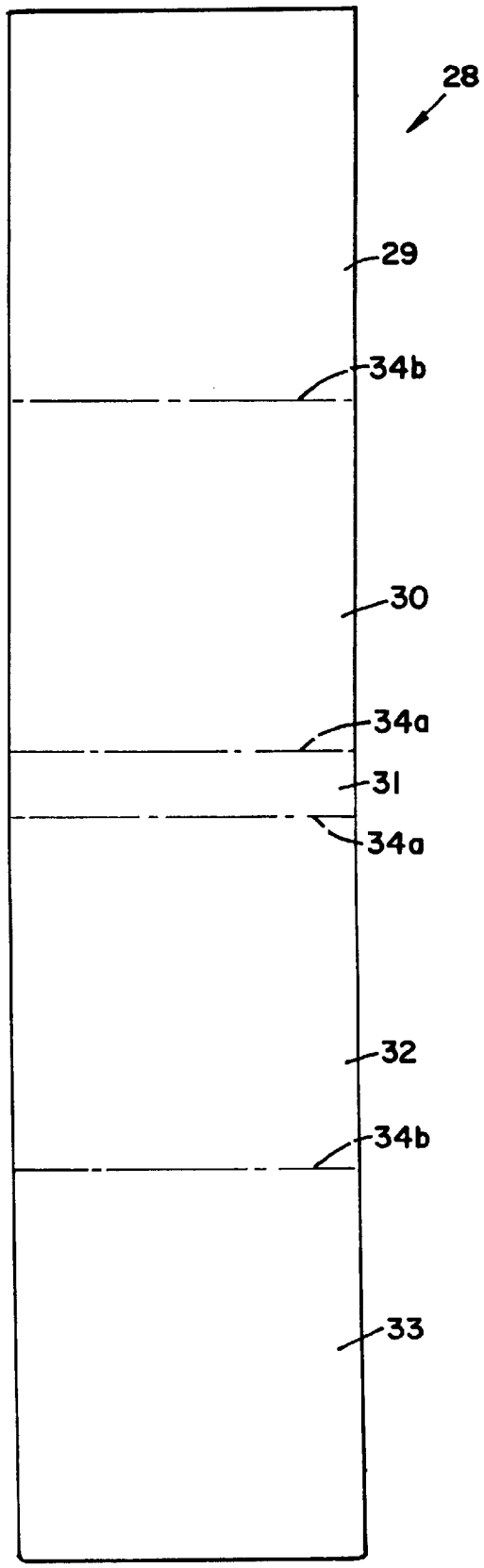
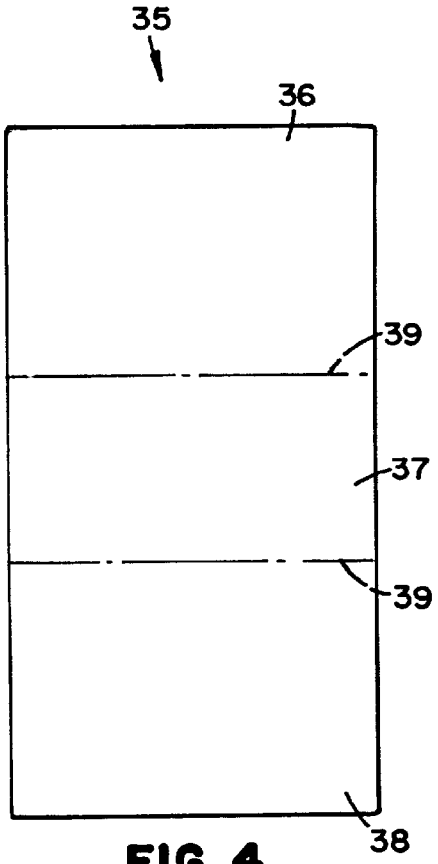
FIG. 4

HARD TACO SHELL PROTECTIVE PACKAGING

BACKGROUND OF THE INVENTION

1. Field of the Invention

The present invention relates to protective packaging, and more specifically, to protective packaging for hard taco shells.

2. Description of the Prior Art

A common problem with protective packaging for frangible food substances such as hard taco shells is breakage of the food substances during shipping and handling. Such breakage is undesirable because the breakage may adversely affect usage of the food substances. For example, with hard taco shells, the shells may break in such a manner preventing filling of the shell with meats or other taco fillings. Approximately 99% breakage of hard taco shells occurs along the hinge of the shell, which adversely affects the use of the taco shells. There are types of protective packaging designed to prevent breakage of hard taco shells.

U.S. Pat. No. 4,018,905 by Adamek et al. is directed to a taco package. The package includes a plurality of nested taco shells located within a tray. The tray has two diagonally oriented and inwardly folded flaps which position the shells against one another in the nested array and which, in combination with a shrink film covering over the taco shells and the tray, reduces breakage of the shells during shipment and storage.

U.S. Pat. No. 4,055,670 by Belmont discloses a package for storing and transporting tortillas or tacos where the tortillas or tacos are in individual compartments and have individual spacers within the package.

U.S. Pat. No. 4,299,850 by Wallen et al. discloses a package for protecting fragile food items against damage. The package includes a tray being formed with a cutout defining a saddle and a return bend portion defining a slot having a retaining wall and a plurality of nested, generally U-shaped pastry units associated with the tray saddle and slot. The tray and pastry units being enclosed within an outer plastic film.

U.S. Pat. No. 4,381,837 by Cortopassi discloses a package having a plurality of openings or recesses that are aligned. These aligned recesses form support for the ends of each one of the taco shells in a nested relationship contained in the package.

U.S. Pat. No. 4,653,645 by Thomas is of general interest and discloses a taco holder and serving element combination.

U.S. Pat. No. 4,697,707 by Engdahl discloses another taco shell package to avoid breakage from external forces. The top panel and bottom panel both extend beyond the area covered by the taco shells. If force is applied to the top of the container, the taco shells may be displaced toward the bottom panel without any breakage of the shells. The corner panels have sufficient height to provide points at which forces can be absorbed to protect the shells. At least one holding member frictionally engages the opposing interior surfaces of one shell. The holding member has serrated edges that include contact points. Perforations are also provided in the holding member to provide a resilient character to the serrated edges. A bottom member interfaces the exterior surface of another shell to assist in maintaining the shells in a position within the package.

Finally, U.S. Pat. No. 5,326,577 by Warnock discloses a three-layer, L-shaped packing assembly for fragile food products that is covered by a shrink-wrap. The backing of the packing assembly extends beyond the edge of the food products.

SUMMARY OF THE INVENTION

In a preferred embodiment protective packaging for frangible food substances, a pad has a size at least equal to the perimeter of a frangible food substance and includes a top portion and a bottom portion. A first leg protrudes from and is operatively connected to the top portion and a second leg protrudes from and is operatively connected to the bottom portion. The pad supports the frangible food substance. A film is wrapped securely around the pad, the first leg, the second leg, and the frangible food substance. The film conforms to the shape of the frangible food substance and the pad without interference from the first leg and the second leg. The first leg and the second leg are arranged to hold the film securely around the pad and the frangible food substance thereby preventing the frangible food substance from sliding around within the film and reducing breakage of the frangible food substance.

In another preferred embodiment protective packaging for frangible food substances, a pad includes a top portion, a first side portion, a second side portion, and a bottom portion. The pad supports the frangible food substances and has a size at least equal to the perimeter of the frangible food substances. A first leg protrudes from and is operatively connected to the pad proximate the top portion and the first side portion. A second leg protrudes from and is operatively connected to the pad proximate the top portion and the second side portion. A third leg protrudes from and is operatively connected to the pad proximate the bottom portion and the second side portion. A fourth leg protrudes from and is operatively connected to the pad proximate the bottom portion and the first side portion. The first leg, second leg, third leg, and fourth leg provide additional protection against damage to the frangible food substances by preventing contact with the frangible food substances and the pad and absorbing shock when force is exerted upon the legs to prevent breakage of the frangible food substances. A film is wrapped securely around the pad, the legs, and the frangible food substances to prevent the frangible food substances from sliding around within the film and reduce the breakage of the frangible food substances.

BRIEF DESCRIPTION OF THE DRAWINGS

FIG. 3 is a top view of a divider insert of the protective packaging shown in FIGS. 1 and 2.

FIG. 4 is a top view of a U-shaped insert of the protective packaging shown in FIGS. 1 and 2.

DETAILED DESCRIPTION OF THE PREFERRED EMBODIMENT

Figure 1:
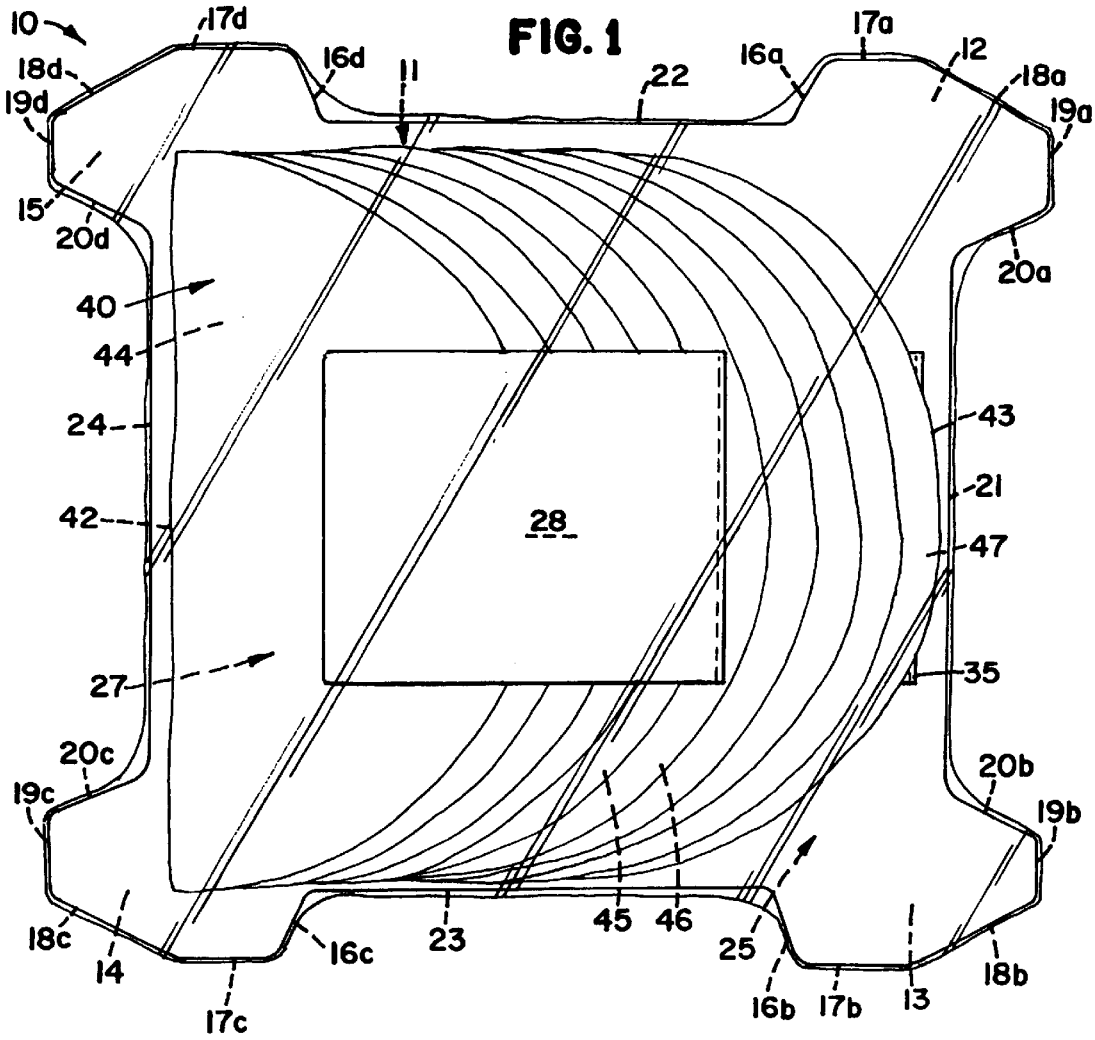
FIG. 1 is a top view of a protective packaging for hard taco shells.
Figure 2:
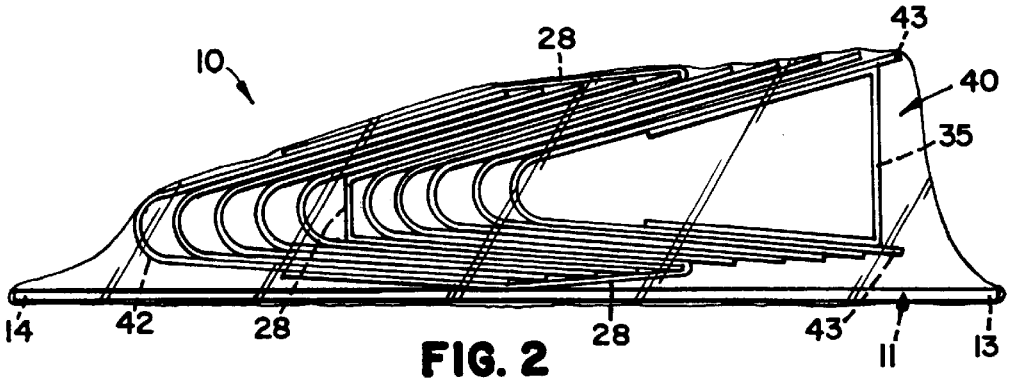
FIG. 2 is a side view of the protective packaging shown in FIG. 1.

A preferred embodiment protective packaging constructed according to the principles of the present invention is designated by the numeral 10 in FIGS. 1 and 2. The preferred embodiment protective packaging 10 is directed to a protective packaging for hard taco shells 27. It is understood, however, that the present invention may be modified to provide an improved packaging container for other brittle yet perishable food substances.

FIGS. 1 and 2 show the preferred embodiment protective packaging 10. The protective packaging 10 includes a pad 11 having a first leg 12, a second leg 13, a third leg 14, and a fourth leg 15 that compress when a force is exerted upon them to prevent breaking the taco shells 27 contained within the protective packaging 10. A top portion 21 interconnects first leg 12 and second leg 13, a first side portion 22 interconnects first leg 12 and fourth leg 15, a second side portion 23 interconnects second leg 13 and third leg 14, and a bottom portion 24 interconnects third leg 14 and fourth leg 15. The portions 21–24 define the perimeter of a rectangular shaped pad 11, not including the legs 12–15 at each corner of the pad 11, and the perimeter of pad 11 is at least as large as the nested taco shells 27 contained within the protective packaging 10. In the preferred embodiment protective packaging 10, the perimeter of pad 11 is approximately the same size as the nested taco shells 27 to ensure a snug fit of the protective packaging 10 around the taco shells 27. Therefore legs 12–15 are operatively connected to pad 11 and protrude outwardly from pad 11 at each corner to provide protection against breakage of the taco shells 27 and to also assist in conforming the shrink film 40 around pad 11 and taco shells 27. Although four legs are shown in the preferred embodiment, it is understood that fewer or more legs may be used to accomplish the same protection of shells 27 as long as the shrink film 40 conforms to the pad 11 and the taco shells 27.

The pad 11 may or may not be made from a corrugated material. The preferred embodiment uses a pad 11 made from a 26ECT, C-Flute corrugated material. The less rigid legs 12–15 are, the more shock they will absorb when the protective packaging 10 is dropped or impacted in some way. When force is exerted upon the edges of legs 12–15 of the protective packaging 10, legs 12–15 compress and the remainder of pad 11 does not compress. Therefore, the majority of the shock is absorbed by the legs 12–15 and not by the remaining area of pad 11. This maximizes protection against breakage of the taco shells 27 because the area of pad 11 having contact with the taco shells 27 does not compress and legs 12–15, which do compress to absorb shock, prevent force from being exerted upon the taco shells 27. Legs 12–15 have angled edges 16*a–d*, 17*a–d*, 18*a–d*, 19*a–d*, and 20*a–d* that allow legs 12–15 to be less rigid thereby maximizing the compression of the legs to absorb shock. The legs 12–15 are less rigid because there is less surface area than if the legs 12–15 were rectangular shaped. The angled edges 16*a–d*, 17*a–d*, 18*a–d*, 19*a–d*, and 20*a–d* also provide edges to assist in positioning the pad 11 during automated packaging. It is understood, however, that legs 12–15 may have more or less angled edges and may still serve the same function in absorbing shock and assisting in automated packaging.

The protective packaging 10 also utilizes a paperboard U-shaped insert 35, which protects the shells 27 in side to side impact and is shown in FIG. 4. The U-shaped insert 35 is arranged inside the opening of the tenth taco shell 47 of the nested arrangement of taco shells 27 to prevent breakage when force is applied to the sides of the taco shells 27 rather than to the legs 12–15 of pad 11. The U-shaped insert 35 is folded along its score lines 39 on each side of second section 37 thus defining first section 36 and third section 38. After U-shaped insert 35 is folded, first section 36 and third section 38 are inserted into the opening of the tenth shell 47 so that the second section 37 aligns with the top 43 of tenth shell 47. Second section 37 prevents the top edges of top 43 from coming together and breaking hinge 42 of the shells 27 when force is applied to the sides of the shells 27.

In addition, the protective packaging 10 may optionally include a divider insert 28 between the fifth shell 45 and the sixth shell 46, as shown in FIGS. 1–3, to help reduce breakage of the taco shells 27. Divider insert 28 has a plurality of score lines 34 to divide the insert 28 into several sections. First, the first taco shell 44 through the fifth taco shell 45 are nested together and the sixth taco shell 46 through the tenth taco shell 47 are nested together. Then, the third section 31 is placed proximate the hinge 42 of the sixth taco shell 46. The divider insert 28 is folded along its score lines 34*a* on each side of the third section 31 to wrap the second section 30 around one side of the sixth taco shell 46 and the fourth section 32 around the other side of the sixth taco shell 46. Once this is done, all ten taco shells 27 may be nested together with divider insert 28 between the fifth taco shell 45 and the sixth taco shell 46. Score lines 34*b* are then folded to span the first section 29 across one side of the first taco shell 44 through the fifth taco shell 45 and to span the fifth section 33 across the other side of the first taco shell 44 through the fifth taco shell 45. As shown in FIG. 2, divider insert 28 forms a M-shape between the fifth taco shell 45 and the sixth taco shell 46 to relieve some of the pressure from the other shells 27 within the protective packaging 10 when the taco shells 27 become more tightly nested together.

The taco shells 27 are packaged in a nested arrangement on the front side 25 of pad 11 within the perimeter. As discussed above with respect to the preferred embodiment, the perimeter of pad 11 covers an area approximately the same size or slightly greater than the area covered by the taco shells 27. The pad 11 has a dimension of approximately 6½ to 7¾ inches by approximately 6⅜ to 7 inches and the taco shells 27 have a dimension of approximately 6 to 6⅛ inches by approximately 5¾ to 6 inches. In the preferred embodiment protective packaging 10, ten taco shells 27 are nested together with each hinge 42 in a downward orientation and each top 43 in an upward orientation with respect to pad 11. When contained within the protective packaging 10, the hinge 42 of the first shell 44 abuts the bottom portion 24 of pad 11 and the top 43 of the tenth shell 47 abuts the top portion 21 of pad 11. U-shaped insert 35 and optionally, divider insert 28 are arranged within taco shells 27 as described above before taco shells 27 are arranged within the perimeter on the front side 25 of pad 11. Once the nested taco shells 27 are placed on the front side 25 of pad 11, the shells 27 are shrink-wrapped onto the pad 11 with shrink film 40. The shrink film 40 conforms to the shape of the taco shells 27 on the pad 11 without interference from the legs 12–15, creating the protective packaging 10. In the preferred embodiment, numerous shrink film types and thicknesses could be used, but 75 gauge (0.00075 inch) polyolefin film provides the most ideal shrink characteristics. After the protective packaging 10 has been shrink-wrapped, the protective packaging 10 is then placed inside a protective carton, which is not shown in the Figures.

When the protective packaging 10 containing the taco shells 27 is dropped proximate the top portion 21 or the bottom portion 24, the shells 27 may become more tightly nested together, creating gap in the protective packaging 10 along the top portion 21 and the bottom portion 24. In addition, the shrink film 40 may stretch as a result of an applied force causing the taco shells 27 to move within the shrink film 40 thereby loosening the snug fit of the protective packaging 10. In other words, protective packaging 10 is a suspension package of the taco shells 27, and protective packaging 10 allows for travel of the taco shells 27 approximately one quarter of an inch. This reduces the breakage of the taco shells 27 after force is applied to the protective packaging 10 because the taco shells 27 do not immediately stop but gradually come to a stop to lessen any impact they may receive. Despite the loosening of the snug fit of protective packaging, 10 in either instance, legs 12–15 are designed to prevent the taco shells 27 from extending beyond the edges 17*a–d* and 19*a–d*. Therefore, the taco shells 27 should not receive direct impact when the protective packaging is dropped along the edges of pad 11. Approximately 99% breakage of hard taco shells 27 occurs along the hinge 42 of the shells 27, which adversely affects the use of the taco shells 27, and protective packaging 10 is designed to reduce this breakage along with other types of breakage that may occur.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A protective packaging for frangible food substances, comprising:

a. an arrangement of frangible food substances having a perimeter;

b. a pad including a top portion, a first side portion, a second side portion, and a bottom portion, said pad supporting said frangible food substances wherein said pad has a size at least equal to said perimeter of said frangible food substances;

c. a first leg operatively connected to said pad and protruding from said pad between said top portion and said first side portion, said first leg being on the same plane as said pad and providing additional protection against damage to the food substances, wherein said first leg prevents contact with said frangible food substances and said pad and absorbs shock when force is exerted upon said first leg to prevent breakage of said frangible food substances;

d. a second leg operatively connected to said pad and protruding from said pad between said top portion and said second side portion, said second leg being on the same plane as said pad and providing additional protection against damage to the food substances, wherein said second leg prevents contact with said frangible food substances and said pad and absorbs shock when force. is exerted upon said second leg to prevent breakage of said frangible food substances;

e. a third leg operatively connected to said pad and protruding from said pad between said bottom portion and said second side portion, said third leg being on the same plane as said pad and providing additional protection against damage to the food substances, wherein said third leg prevents contact with said frangible food substances and said pad and absorbs shock when force is exerted upon said third leg to prevent breakage of said frangible food substances;

f. a fourth leg operatively connected to said pad and protruding from said pad between said bottom portion and said first side portion, said fourth leg being on the same plane as said pad and providing additional protection against damage to the food substances, wherein said fourth leg prevents contact with said frangible food substances and said pad and absorbs shock when force is exerted upon said fourth leg to prevent breakage of said frangible food substances; and g. a film wrapped securely about said pad, said first leg, said second leg, said third leg, said fourth leg, and said frangible food substances thereby reducing breakage of said frangible food substances.

2. The protective packaging of claim 1, wherein said film, when a force is applied thereto, will stretch thereby loosening said film about said frangible food substances and allowing movement of said frangible food substances thereby reducing breakage of said frangible food substances.

3. The protective packaging of claim 1, wherein said legs prevent contact with said frangible food substances when force is exerted upon at least one of said legs.

4. The protective packaging of claim 1, wherein each of said legs includes an angled edge that provides additional protection against damage to the food substances by absorbing shock from force applied to at least one of said legs.

5. The protective packaging of claim 1, wherein said pad has a length of approximately 6½ to 7¾ inches and a width of approximately 6⅜ to 7 inches, and wherein said arrangement of frangible food substances has a length of approximately 6 to 6⅛ inches and a width of approximately 5¾ to 6 inches.

6. The protective packaging of claim 1, wherein said film conforms to said shape of said arrangement of frangible food substances and said pad without interference from said legs.

7. The protective packaging of claim 1, wherein said frangible food substances are taco shells in a nested arrangement.

8. The protective packaging of claim 1, wherein ten taco shells are included in the protective packaging.

9. The protective packaging of claim 8, further comprising a fifth taco shell, a sixth taco shell, and a divider insert, wherein said divider insert is placed between the fifth taco shell and the sixth taco shell to prevent breakage of the nested taco shells.

10. The protective packaging of claim 7, further comprising a first taco shell in the nested arrangement having an opening, and a U-shaped insert placed in the opening of the first taco shell to prevent breakage of the nested taco shells.

11. The protective packaging of claim 10, further comprising a divider insert placed between at least two taco shells to prevent breakage of the nested taco shells.

12. The protective packaging of claim 7, further comprising a divider insert placed between at least two taco shells to prevent breakage of the nested taco shells.

13. The protective packaging of claim 7, wherein said pad has a length of approximately 6½ to 7¾ inches and a width of approximately 6⅜ to 7 inches, and wherein each taco shell has a length of approximately 6 to 6⅛ and a width of approximately 2¾ to 2⅞ and said nested taco shells have a length of approximately 6 to 6⅛ inches and a width of approximately 5¾ to 6 inches.

* * * * *